US005176313A

United States Patent [19]

Curry et al.

[11] Patent Number: 5,176,313

[45] Date of Patent: Jan. 5, 1993

[54] CARTON AND BLANK FOR MAKING THE SAME

[75] Inventors: Ernest Curry; Maureen Sales, both of Newcastle upon Tyne, England

[73] Assignee: Field Group Limited, Bucks, England

[21] Appl. No.: 421,470

[22] Filed: Oct. 13, 1989

[30] Foreign Application Priority Data

Sep. 8, 1989 [GB] United Kingdom ..... 8920336

[51] Int. Cl.[5] ..... B65D 5/74

[52] U.S. Cl. ..... 229/125.15; 220/403; 220/465; 122/105; 229/137; 229/164

[58] Field of Search ..... 229/125.14, 125.15, 229/125.04, 125.09, 137, 164; 222/105, 143, 540; 220/403, 404, 461, 462, 463, 465; 206/621.3, 621.4, 621.6, 626

[56] References Cited

U.S. PATENT DOCUMENTS

| | | | |
|---|---|---|---|
| 2,111,884 | 3/1938 | Cahaney | 229/915 |
| 3,233,817 | 2/1966 | Casady | 220/465 |
| 3,306,514 | 2/1967 | MacKendrick | 206/621.6 |
| 3,982,683 | 9/1976 | Forteau | 206/621.4 |
| 4,214,675 | 7/1980 | Schmit | 222/105 |
| 4,560,090 | 12/1985 | Okushita | 220/463 |
| 4,572,422 | 2/1986 | Heuberger et al. | 220/461 |
| 4,754,917 | 7/1988 | Gordon et al. | 229/137 |
| 4,971,243 | 11/1990 | Lisiecki | 229/125.15 |
| 5,048,691 | 9/1991 | Heuberger et al. | 220/465 |

FOREIGN PATENT DOCUMENTS

| | | | |
|---|---|---|---|
| 84018 | 7/1983 | European Pat. Off. | 206/621.3 |
| 860129 | 2/1961 | United Kingdom | 220/403 |
| 1418808 | 12/1975 | United Kingdom . | |

*Primary Examiner*—Gary E. Elkins
*Attorney, Agent, or Firm*—Lyon & Lyon

[57] ABSTRACT

A carton made from a single blank of cardboard, paperboard or the like has a top having a rear portion which is substantially horizontal and a front portion which slopes downwardly and forwardly from said rear portion. The front portion may receive a dispensing spout. The carton is filled by first forming the top of the carton, then filling the carton through the open base and then closing the base. A blank for making the carton has top forming panels, and tuck forming panels connected between the top forming panels and side wall forming panels, the latter connection being by way of a hinge line with two contiguous sections at an angle to each other.

14 Claims, 4 Drawing Sheets

FIG. 2
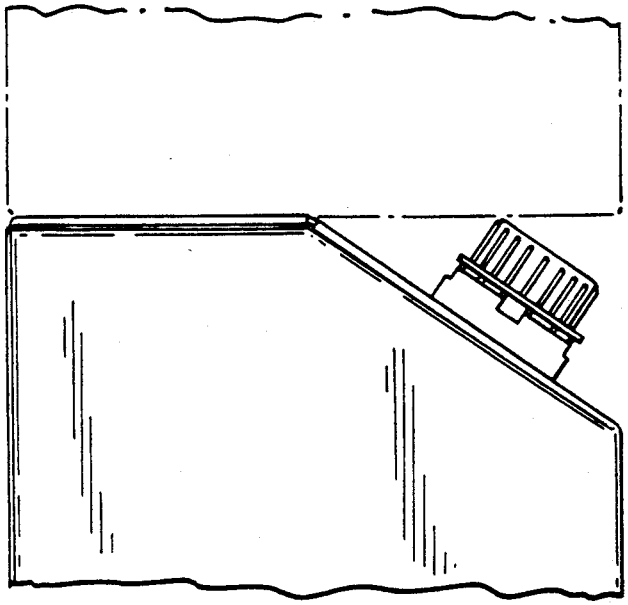
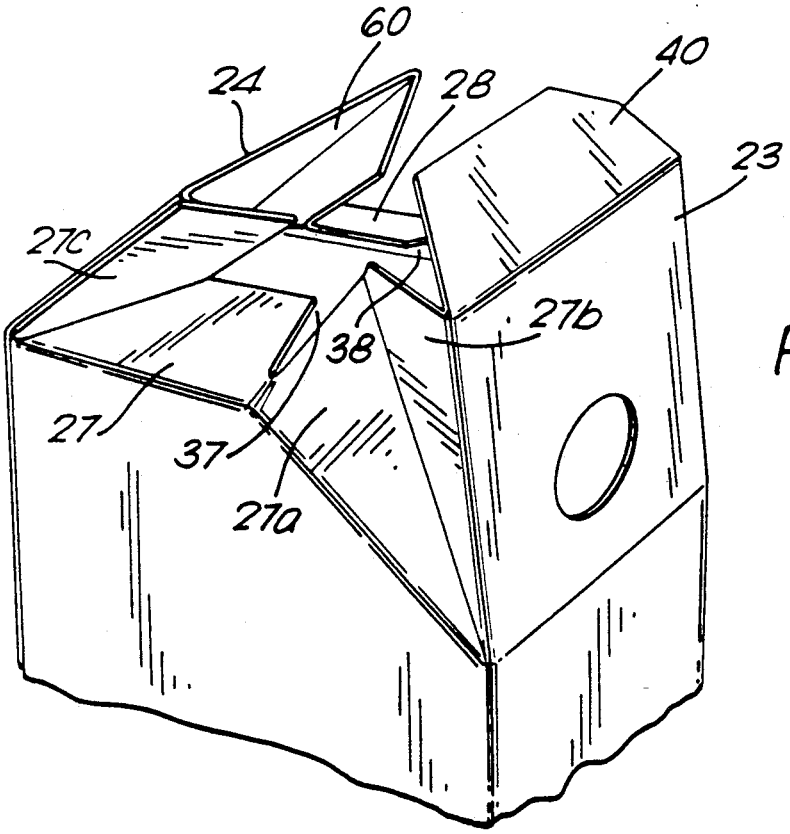
FIG. 4

CARTON AND BLANK FOR MAKING THE SAME

This invention relates to cartons made of cardboard, paperboard or similar lightweight foldable sheet material, and to blanks for making the same, and is particularly directed to the provision of such a carton for carrying and dispensing liquids such as liquid detergents and having improved qualities of liquid-tightness.

Viewed from one aspect the invention provides a carton made from a single blank of cardboard, paperboard or similar lightweight foldable sheet material and having a base, a front wall, a rear wall, two side walls and a top, the top having a rear surface portion which is substantially horizontal for stacking purposes, and a front surface portion which slopes downwardly and forwardly away from the said top surface portion and is suitable for receiving a dispensing spout, the said rear surface portion being formed by a rear top panel hingedly connected to the top of the said rear wall, the said front surface portion being formed by a front top panel hingedly connected to the top of the said front wall, and the said front and rear top panels being connected to the said side walls by respective arrays of inwardly folded tuck panels which underlie the said top panels.

Viewed from another aspect the invention provides a one-piece blank made of cardboard, paperboard or similar lightweight foldable sheet material for forming a carton of the kind set forth above, comprising a row of four hingedly interconnected wall panels for forming the said front, rear and side walls of the carton, an array of base-forming panels on one side of the said row of wall-forming panels, front and rear top-forming panels hingedly connected to the respective front and rear wall-forming panels on the other side of the row, the hinge line between the said front top-forming panel and the front wall-forming panel being nearer to the said base-forming panels than is the hinge line between the said rear top-forming panel and the rear wall-forming panel, and respective arrays of tuck-forming panels hingedly connected between the said front and rear top-forming panels and to the said side wall-forming panels, each of the last-mentioned connections being by way of a hinge line which has two contiguous sections at an angle to each other, one such section being colinear with the hinge line between the rear top-forming panel and the rear side wall-forming panel and the other such section extending obliquely inwardly to meet the adjacent end of the hinge line between the front top-forming panel and the front wall-forming panel.

Preferably the sloping front surface portion is provided with pouring means in the form of dispensing spout. This could be of any desired construction, but preferably it is a pouring spout formed of a plastics material. Advantageously the spout has a mounting flange which locates against the inside of the sloping top surface. Preferably, if the carton is formed of thermoplastics coated paperboard, the flange is of a material which has the same melting point as the thermoplastic coating of the carton material so that it may be fixed thereto by sonic welding. It is particularly advantageous if the pouring spout extends from the sloping surface to a point where it forms a plane with the horizontal top surface. This facilitates stacking.

Preferably the tuck-forming panels are each formed with tuck hinge lines extending inwardly and upwardly from the ends of the hinge line joining the tuck-forming panels to the side wall-forming panels, to define a central panel and two outer panels, each outer panel being connected along a further hinge line to an adjacent top-forming panel. During assembly, as the top-forming panels are folded about their respective hinge lines to close the top of the carton, the tuck-forming panels are folded inwardly, so that the outer tuck panels will overlie the central tuck panel and the top-forming panels will overlie both.

To obviate buckling of the tuck-forming panels during folding, each may be formed with a cut out extending from its upper surface towards the point of intersection of the two contiguous sections of the hinge line joining the side wall-forming panels to the array of tuck forming panels. Preferably the cut out terminates short of the point of intersection, to ensure a good seal. It would of course be possible to provide a series of further folds instead of a cut out, but the latter is preferred since it puts less stress on any thermoplastic coating material of the carton.

The height of the top-forming panels is preferably substantially the same as the length of the adjacent section of the hinge line joining the array of tuck forming panels to the side walls. In this way when the carton is erected, the respective top-forming panels will meet along the junction between the horizontal and sloping areas of the top.

In a particularly preferred arrangement one of the top-forming panels, preferably the front top-forming panel has a flap connected to its upper edge along a hinge line. During assembly, this flap is introduced into a pocket formed between the opposed tuck-forming panels and other top-forming panel. The corners of the flap are preferably cut at an angle to facilitate this.

The blank may have a securing strip extending along the edge of one of the outer side panels. Preferably it is attached to the side wall-forming panel which is opposite that having the top-forming panel. During assembly, the outer surface of the securing strip is adhered by suitable means to the inside edge of the adjacent side wall-forming panel to form a tubular blank. Of course, the sealing strip could be formed adjacent another side wall-forming panel.

The invention also provides, from another aspect, a method of filling a carton as described above comprising the steps of forming the top of the carton, then filling the carton through the open base with the carton inverted, and then closing the base of the carton.

In more detail, the procedure of forming and filling a carton according to the invention may comprise, firstly, forming the carton blank into an open-ended tubular structure by securing the terminal walls of the row to each other, for example by means of a conventional flamesealing strip provided at one end of the row. A pouring spout, if required, may then be attached to the tubular structure. Preferably, as stated above, the spout is formed with a flange which engages around the back of a hole formed in the sloping top panel, the flange being of a thermoplastics material with the same melting point as the thermoplastics coating material of the carton, so that the flange may be attached to the carton by heating or ultrasonic welding.

With the spout attached, the top of the carton is then formed. The tubular structure, with its top pre-folded, may be placed on a mandrel and hot air directed at those parts of the top where it is desired to melt the thermoplastic coating for adhesive purposes. The top-forming and tuck-forming panels are then folded into their final positions and the top closure clamped firmly between an anvil and the mandrel to ensure that good contact is obtained between the components to achieve a good seal. Of course other ways of adhering the various components of the top closure to one another can be envisaged such as selective application of adhesive. The top could also be ultraconically welded on the mandrel.

Once the top closure has been formed, the carton may be filled with a chosen liquid such as a detergent, a dairy produce or a food product for example.

Once filled, the base is then formed. The base of the carton may be of any convenient kind. However one advantageous construction is of the type commonly seen in cartons containing fruit juices and the like. In this arrangement, base-forming panels are joined to the bottom edges of the side wall-forming panels along colinear hinge lines, with a further hinge line extending along the base-forming panels parallel to the colinear hinge lines to form a strip of sealing panels between the hinge line and the terminal edge of the blank. The base-forming panels attached to the side wall-forming panels having the top-forming panels have further hinge lines extending inwardly from their upper corners to the parallel hinge line to define a triangular panel, and a vertical hinge line extending from the parallel hinge line to the free edge of the blank.

Such a bottom closure will be closed in the following manner. Firstly, the triangular portions referred to above are pulled outwardly and the closure panels on the other two walls pushed inwardly to bring opposed surfaces of the sealing panels together. These are then heated and pressed together by for example a plough arrangement to form an upstanding fin which is then folded onto and adhered to the flattened closure panels with finally the triangular closure panels being folded over on top of both and adhered thereto.

This method of construction allows the folds in the top of the carton to be secured firmly in position on a mandrel and a substantially flat bottom surface to be provided on the carton.

One embodiment of the invention will now be described, by way of example, with reference to the following drawings in which:

FIG. 2 shows how cartons in accordance with the invention may be stacked;

FIG. 4 shows an intermediate stage in the erection of a carton in accordance with the invention.

Figure 1:
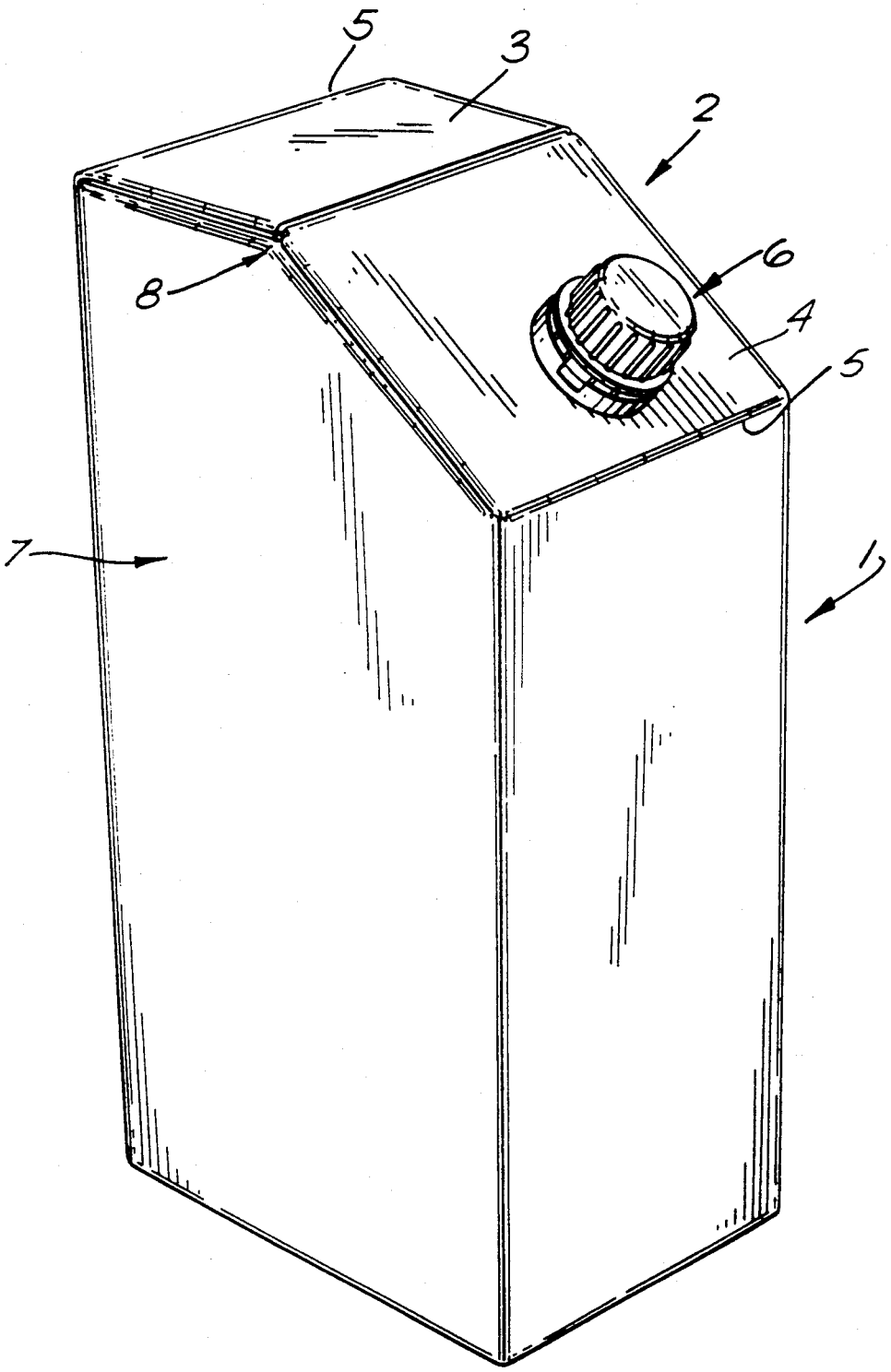
FIG. 1 shows a carton in accordance with the invention.

With reference to FIG. 1, a carton 1 for holding liquid detergents or the like is formed from one-piece blank of thermoplastics coated paperboard and has a top 2 with a rear, substantially horizontal, portion 3 and a front, downwardly sloping, portion 4. These respective portions are formed by respective rear and front top-forming panels (24,23 FIG. 3) attached to respective side walls along folds 5 vertically displaced from one another. A screw topped pouring spout 6 with a removable cap is provided in the sloping portion 5. As can be seen from FIG. 2, the top of the pouring spout 6 lies in the same plane as the portion 3, which facilitates stacking of the cartons.

The side walls 7 each have a trapezoidal shape, being delimited at their upper ends by a hinge line 8.

Figure 3:
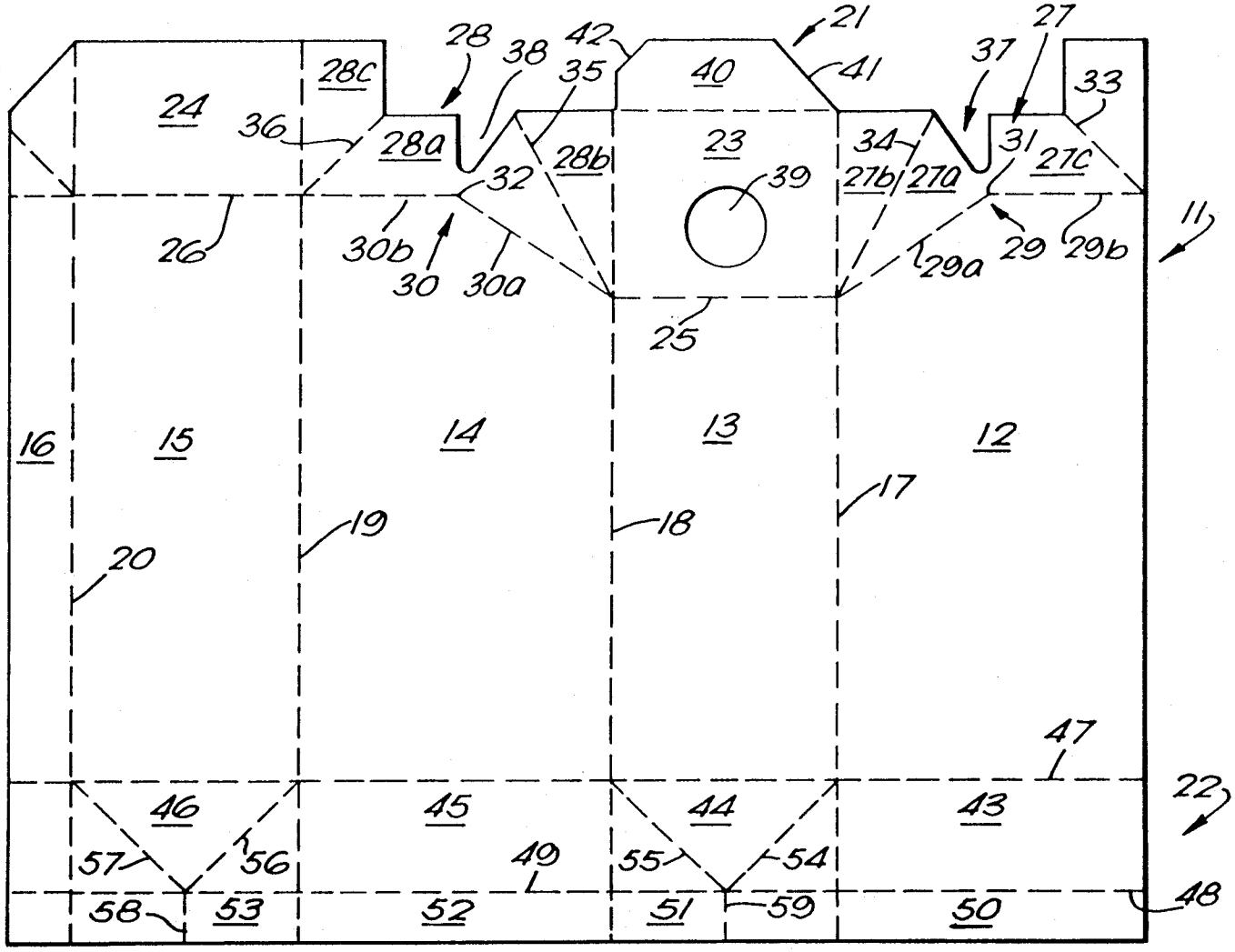
FIG. 3 shows a carton blank from which the carton of FIG. 1 may be erected.

The above carton may be produced from a blank as shown in FIG. 3. With reference to that Figure, a cut and scored blank 11 has four side wall-forming panels 12–15 and a securing strip 16. These panels are joined along hinge, fold or score lines 17–20. The blank is also formed with a top closure 21 and base closure 22.

Top closure 21 comprises top-forming panels 23,24 which are connected to the upper edges of front and rear wall-forming panels 13,14 respectively along straight hinge lines 25,26. Hinge line 25 is nearer the base-forming panels than hinge line 26. The top closure also comprises an array of tuck-forming panels 27,28 which are connected to the upper edges of side wall-forming panels 12,14 along hinge lines 29,30. These hinge lines are each in two contiguous sections 29*a*, 29*b*, 30*a*, 30*b*, which are at an angle to each other, meeting at an apices 31,32. The sections 29*b* and 30*b* are colinear with the hinge line 26 between the rear top forming panel 24 and the rear side wall-forming panel 15, and the sections 29*a* and 30*a* slope downwardly away from the portions 29*b* and 30*b* to the hinge lines 25. The lengths of portions 29*a* and 30*a* are substantially equal to the height of the panel 23 while the lengths of portions 29*b* and 30*b* are substantially equal to the height of panel 24.

Upon assembly, the side wall panels 12,14 will form the trapezoidal sides 7 of the erected carton bounded at the top by the folds 8 made along the hinge lines 19,20, while the panels 23,24 will form the front and rear top surfaces 4,3 respectively of the carton.

The tuck-forming panels 27,28 have tuck hinge lines 33–36 which divide each panel into respective central portions 27*a*, 28*a* and outer portions 27*b,c*, 28*b,c*,. Cut outs 37,38 extend from the free edge of the panels 27,28 towards but not as far as the respective apices 29,30. The cut outs reduce the stresses in the thermoplastic coating of the carton material during assembly of the carton. Since the cut outs 37,38 do not extend to the apices 31,32, there will- be a much improved seal in this area in the erected carton. The portions of the central panels 27*a*, 27*b* to either side of the cut out are substantially symmetrical with the respective adjacent outer panels 27,*b,c*, 28*b,c*, about the hinge lines 33–36 so that a maximum overlap of these panels will be achieved upon erection of the blank.

The panel 23 has an aperture 39 for accepting a pouring spout as will be described later and also has a flap 40 with chamfered edges 41,42 connected along its upper edge for a purpose that will be described later.

Turning now to the base of the container, the base closure 22 comprises an array of base-forming panels 43–46 connected to the bottom edges of the side wall panels 12–15 along a hinge line 47. Parallel to hinge line 47 there is a further hinge line 48 which together with hinge line 47 defines a sealing strip 49 made up from a plurality of panels 50–53. Hinge lines 54–57 in panels 44, 46 divide the panels 44,46 into triangular portions. Further hinge lines 58,59 extend from the apex of the central triangular portion of each of the free edge of the strip 49.

The erection of the carton as described above will now be explained.

After cutting and scoring the blank by conventional methods, it is first erected into a tubular structure by folding along the hinge lines 17–20 and sealing the outer surface of the securing strip 16 to the inner surface of opposed panel 12. The sealing may be achieved by any conventional method e.g. flamesealing.

After this, the pouring spout 6 may be attached to the front top forming panel 23. This is done by passing the spout 6 through an aperture 39 from the inside until a flange at its base abuts the inner surface of the panel 23 around the aperture 39. This may then be secured on the surface by, for example, ultrasonic welding. The spout 6 could, alternatively, be added after formation of the top closure, which will now be described.

With reference to FIG. 4, the top closure is formed with the blank being placed on a mandrel (not shown). The top-forming panels 23, 24 are pushed together (by means not shown) with the array of tuck-forming panels 27,28 being pushed inwardly to lie under the panels 23,24. At the same time, the flap 40 is pushed into the pocket 60 formed behind the outer portions of the tuck-forming panels 27,28.

To achieve a good seal, substantially the whole overlapping areas of the central portions 27*a*, 28*a* and the outer portions 27*b,c*, 28*b,c*, of the tuck-forming panels 27,28 are adhered to one another, and the flap 40 is adhered inside the pocket 60. This may conveniently be done by melting the thermoplastic coating on these portions by, for example, hot air jets and pressing them together between the mandrel and an anvil. In this way a substantial pressure may be applied in order to properly form the folds and achieve good sealing between the portions. The top could alternatively be ultrasonically welded on the mandrel.

The cut outs 37,38 allow the tuck-forming panels to fold in without substantial buckling. This means that the thermoplastics coating on the carton material in this region will not be ruptured. It should be noted that after assembly, the opposed edges of each cut out 37,38 will lie substantially adjacent one another.

Figure 5:
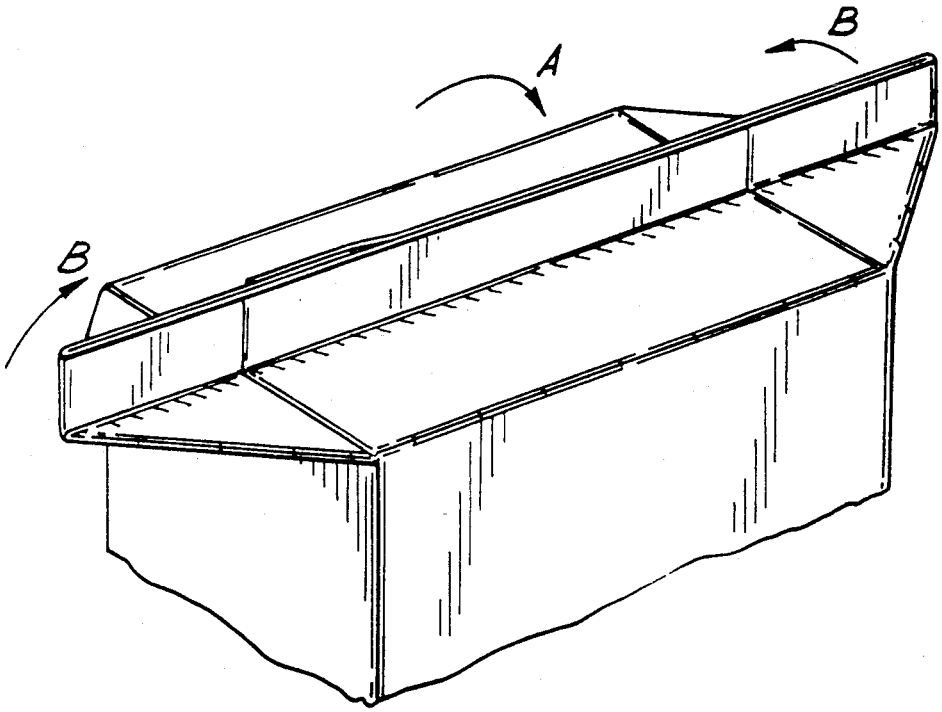
FIG. 5 shows a later stage in the erection of the carton shown in FIG. 4.

Once the top closure is formed, the carton may be filled with liquid to a predetermined level, after which the base is formed. Panels 43 and 45 are pushed together while panels 44 and 46 are pulled outwardly, in order that the sealing strip panels 50–53 overlie one another. Opposed panels are then adhered together to form a sealing fin 61 upstanding from a substantially flat base, as shown in FIG. 5. This may be done by melting the thermoplastic coating on the inner surfaces of the sealing panels 50–53 and pressing them together with a plough or roller arrangement. The sealing fin 61 is then folded over in the direction of arrow A and sealed onto the base surface 62, after which the triangular lugs 63, 64 are folded back on to and adhered to the base surface 62, as shown by the arrows B.

It will be noted that the bottom edge of the sealing strip 16 will be attached to the inner surface of sealing panel 50, which gives a very satisfactory seal in this area.

The above method of construction allows the folds of the top closure to be sealed effectively under considerable pressure, while allowing a substantially flat base to be formed after the carton has been filled.

It is to be clearly understood that there are no particular features of the foregoing specification, or of any claims appended hereto, which are at present regarded as being essential to the performance of the present invention, and that any one or more of such features or combinations thereof may therefore be included in, added to, omitted from or deleted from any of such claims if and when amended during the prosecution of this application or in the filing or prosecution of any divisional application based thereon. Furthermore the manner in which any of such features of the specification or claims are described or defined may be amended, broadened or otherwise modified in any manner which falls within the knowledge of a person skilled in the relevant art, for example so as to encompass, either implicitly or explicitly, equivalents or generalisations thereof.

We claim:

1. A carton made from a single blank of a lightweight foldable sheet material such as cardboard or paperboard, said carton having a base, a front wall, a rear wall, two side walls and a top, the top having a rear surface portion which is substantially horizontal and a front surface portion which slopes downwardly and forwardly away from the said top surface portion and is suitable for receiving a dispensing spout, said rear surface portion being formed by a rear top panel hingedly connected to the top of said rear wall, said front surface portion being formed by a front top panel hingedly connected to the top of said front wall, and said front and rear top panels being connected to both said side walls by respective arrays of inwardly folded tuck panels, each of which tuck panels is hingedly connected both to a said top panel and a side wall panel and which tuck panels underlie the said top panels.

2. A carton as claimed in claim 1, wherein the sloping front surface portion is provided with pouring means in the form of dispensing spout.

3. A carton as claimed in claim 2, wherein the pouring spout extends from the sloping surface to a point where it forms a plate with the horizontal top surface.

4. A carton made of one-piece of a lightweight foldable sheet material such as cardboard or paperboard for forming a carton having a base, a front wall, a rear wall, two side walls and a top, the top having a rear surface portion which is substantially horizontal and a front surface portion which slopes downwardly and forwardly away from the said rear surface portion and is suitable for receiving a dispensing spout, said carton blank comprising a row of hingedly interconnected wall panels for forming said front, rear and side walls of the carton, an array of base-forming panels on one side of the said row of wall-forming panels, front and rear top-forming panels hingedly connected to the respective front and rear wall-forming panels on a side of the row of hingedly interconnected wall panels opposite to the base forming panels, a hinge line between the front top-forming panel and the front wall-forming panel being nearer to the said base-forming panels than is a hinge line between the rear top-forming panel and the rear wall-forming panel, and respective arrays of tuck-forming panels hingedly connected between the front and rear top-forming panels and the side wall-forming panels by connection means, the connection means between the tuck forming panels and a side wall forming panel being by way of a two-section hinge line which has two contiguous sections at an angle to each other, a first section of said hinge line being substantially colinear with a hinge line between the rear top-forming panel and the rear wall-forming panel and a second section of said dine line extending obliquely inwardly to meet an adjacent end of a hinge line between the from top-forming panel and the front wall-forming panel.

5. A carton blank as claimed in claim 4, wherein said tree top-forming panel and said front top-forming panel are connected to a mutually adjacent side wall-forming panel by first and second tuck-forming panels respectively, said first tuck-forming panel being connected to said side wall-forming panel by a said first section of a said two-section hinge line and to said her top-forming panel by further hinge in, said second tuck-forming panel being connected to said side wall-forming panel by a said second section of said two-section hinge line and to said front top-forming panel by a yet further hinge line, said a first and second tuck-forming panels each having tuck-hinge lines extending upwardly and inwardly from respective outer ends of the said two-section hinge line.

6. A carton blank as claimed in claim 5, wherein said tuck hinge lines angularly bisect said first and second tuck-forming panels.

7. A carton blank as claimed in claim 5, wherein said first tuck-forming panel is joined to said second tuck-forming panel by a web of material extending upwardly from the point of intersection of the said first and second sections of the two-section hinge line between the tuck-forming panels and the side wall-forming panel.

8. A carton blank as claimed in claim 7, wherein said web does not extend to a top edge of said first and second tuck-forming panels so as to define a cut-out therebetween.

9. A carton blank as claimed in claim 8, wherein said first and second tuck-forming panels has opposed, free edges defining said cut-out and are shaped such that upon erection of the carton, said free edges lie adjacent to each other.

10. A carton blank as claimed in claim 5, wherein the side wall-forming panel opposed to said mutually adjacent side wall-forming panel is provided, on its upper edge, with tuck-forming panels which are a mirror image of said first and second tuck forming panels.

11. A carton blank as claimed in claim 4, wherein the front top-forming panel has a flap connected to an upper edge along a hinge line, for insertion in a pocket formed between the said tuck-forming panels and the rear top-forming panel upon erection.

12. A carton blank as claimed in claim 4, wherein the blank has a securing strip extending along the edge of tone of the outer wall-forming panels, for securing to the opposite outer wall panel upon erection.

13. A carton blank as claimed in claim 12, wherein the securing strip is attached to the wall-forming panel which is opposite that having the front top-forming panel.

14. A carton blank as claimed in claim 4, wherein the base-forming panels are joined to bottom edges of the side wall-forming panels along colinear hinge lines, with a further hinge line extending along the base-forming panels parallel to the colinear hinge lines to form a strip of sealing panels between the said colinear hinge lines and a terminal edge of the blank, each base-forming panel attached to those side wall-forming panels to which the top-forming panels are hingedly connected having first and second hinge lines extending inwardly from opposed upper corners thereof to said further hinge line to define a triangular panel with a respective one of said colinear hinge lines, and a vertical hinge line extending from the apex of said triangular panel to a terminal edge of the blank.

* * * * *

UNITED STATES PATENT AND TRADEMARK OFFICE

CERTIFICATE OF CORRECTION

PATENT NO. : 5,176,313

DATED : January 5, 1993

INVENTOR(S) : Ernest Curry, et al.

It is certified that error appears in the above-identified patent and that said Letters Patent is hereby corrected as shown below:

IN THE CLAIMS:

Column 6, line 60, delete "dine" and replace with --hinge--.

Column 7, line 1, delete "her" and replace with --rear--.

Column 7, line 2, delete "in" and replace with --line--.

Signed and Sealed this

Fifth Day of July, 1994

*Attest:*

*Attesting Officer*

BRUCE LEHMAN

*Commissioner of Patents and Trademarks*